US005897395A

United States Patent [19]

Arnett

[11] Patent Number: 5,897,395

[45] Date of Patent: Apr. 27, 1999

[54] MULTI-POSITION JACK FRAME

[75] Inventor: Jaime Ray Arnett, Fishers, Ind.

[73] Assignee: Lucent Technologies Inc., Murray Hill, N.J.

[21] Appl. No.: 08/866,796

[22] Filed: May 30, 1997

[51] Int. Cl.[6] ..... H01R 13/74; H01R 13/71

[52] U.S. Cl. ..... 439/536; 439/557; 439/491; 439/954

[58] Field of Search ..... 439/536–538, 439/488, 557, 954

[56] References Cited

U.S. PATENT DOCUMENTS

| | | | |
|---|---|---|---|
| 3,813,640 | 5/1974 | Carissimi | 439/954 |
| 5,041,018 | 8/1991 | Arnett | 439/536 |
| 5,096,439 | 3/1992 | Arnett | 439/536 |
| 5,096,442 | 3/1992 | Arnett et al. | 439/676 |
| 5,217,190 | 6/1993 | Reed et al. | 439/557 |
| 5,302,140 | 4/1994 | Arnett | 439/557 |
| 5,362,254 | 11/1994 | Siemon | 439/557 |
| 5,419,721 | 5/1995 | Lignelet | 439/701 |
| 5,620,335 | 4/1997 | Siemon | 439/447 |

*Primary Examiner*—Hien Vu

[57] ABSTRACT

A jack frame includes a jack frame block having a front surface, a pair of side surfaces and a top surface. The front surface has a plug opening with a plug axis along which a plug connector can be inserted to connect to the jack frame block. The front surface is dimensioned to be received in a jack opening in a face plate, and the inner periphery of the jack opening is defined in part by a pair of side walls and a top wall. The top surface of the jack frame block has a first surface portion that extends at a first angle relative to the plug axis of the plug opening in the block's front surface, and a second surface portion that extends at a second angle relative to the plug axis. Either the first or the second surface portion can be aligned with the top wall of the jack opening, so the frame block can be mounted on the face plate with a desired orientation depending on which one of the first and the second surface portions is aligned with the top wall of the jack opening. Engagement members on the frame block are arranged to engage walls of the jack opening when the frame block is mounted in the desired orientation, to limit movement of the frame block relative to the face plate.

18 Claims, 5 Drawing Sheets

MULTI-POSITION JACK FRAME

BACKGROUND OF THE INVENTION

1. Field of the Invention

The present invention relates to mounting arrangements for electrical connectors, and particularly to a communications jack frame that can be mounted on a face plate in one of a number of different orientations.

2. Discussion of the Known Art

U.S. Pat. No. 5,096,439 (Mar. 17, 1992) discloses a communications jack and a wall plate having an opening for receiving the jack. The jack has flexible members on its side surfaces, for engaging corresponding slots in the sides of the wall plate opening. The jack is mounted on the wall plate with its front face parallel to the front of the wall plate, i.e., a flush mount. Thus, when a plug connector is inserted in the jack, a wire or cable extends away from the connector in a direction perpendicular to the wall plate. Sufficient space therefore must be available for the cable to bend and be routed in a direction other than perpendicular to the wall plate. See also U.S. Pat. No. 5,041,018 (Aug. 20, 1991); and U.S. Pat. No. 5,302,140 (Apr. 12, 1994).

Recently, a demand has arisen for wall or face plates that allow jacks to be mounted with a sloped orientation, so that the front of the jack will directly face, e.g., a floor surface beneath the face plate. Such a sloped or inclined orientation would allow a cable to be routed directly downward toward the floor when its plug is inserted in the jack. See co-pending U.S. patent application Ser. No. 08/534,218 filed Sep. 26, 1995, and assigned to the assignee of the present invention.

Manufacturers of communication jacks have invested largely in wall plate and mounting box hardware that provides a parallel or flush mounting orientation for the jacks. To build new molds for wall plates that would allow existing jacks to be mounted to face downward (i.e., toward the floor), for customers desiring a sloped jack orientation, would be very expensive. As far as is known, there are no wall plates and jacks that can be combined to allow the jacks to mount either flush or facing downward, at the user's option. As mentioned, different products are needed depending on which mounting orientation is desired. This means additional costs and inventory for the jack and wall plate manufacturers, and for their customers.

Another problem arises with respect to icons, i.e., small legend-bearing tabs that snap onto the front face of the jack. The icons serve to identify the jack function, e.g., whether the jack is associated with a telephone, or a data or modem communications line. If a jack is to be mounted on a face plate in either one of a flush or a sloped orientation, then the icon must be clearly visible to the user in either jack mount position.

SUMMARY OF THE INVENTION

According to the invention, a jack frame includes a jack frame block having a front surface, a pair of side surfaces, and a top surface. The front surface has a plug opening having a plug axis along which a plug can be inserted to connect with the frame block. The front surface is dimensioned to be received in a jack opening in a face plates wherein a portion of the inner periphery of the opening is defined by a pair of side walls and a top wall. The top surface of the jack frame block has a first surface portion extending at a first angle with respect to the axis of the plug opening and a second surface portion extending at a second angle with respect to the plug axis, wherein either the first or the second surface portion can be aligned with respect to the top wall of the jack opening so that the frame block can be mounted on the face plate with a selected orientation depending on which of the first and the second surface portions is aligned with the top wall of the jack opening. First engagement members on the frame block are arranged to engage walls of the jack opening when the frame block is mounted in the selected orientation, to limit movement of the frame block relative to the face plate.

For a better understanding of the invention, reference is made to the following description taken in conjunction with the accompanying drawing, and the scope of the invention will be pointed out by the appended claims.

DETAILED DESCRIPTION OF THE INVENTION

Figure 1:
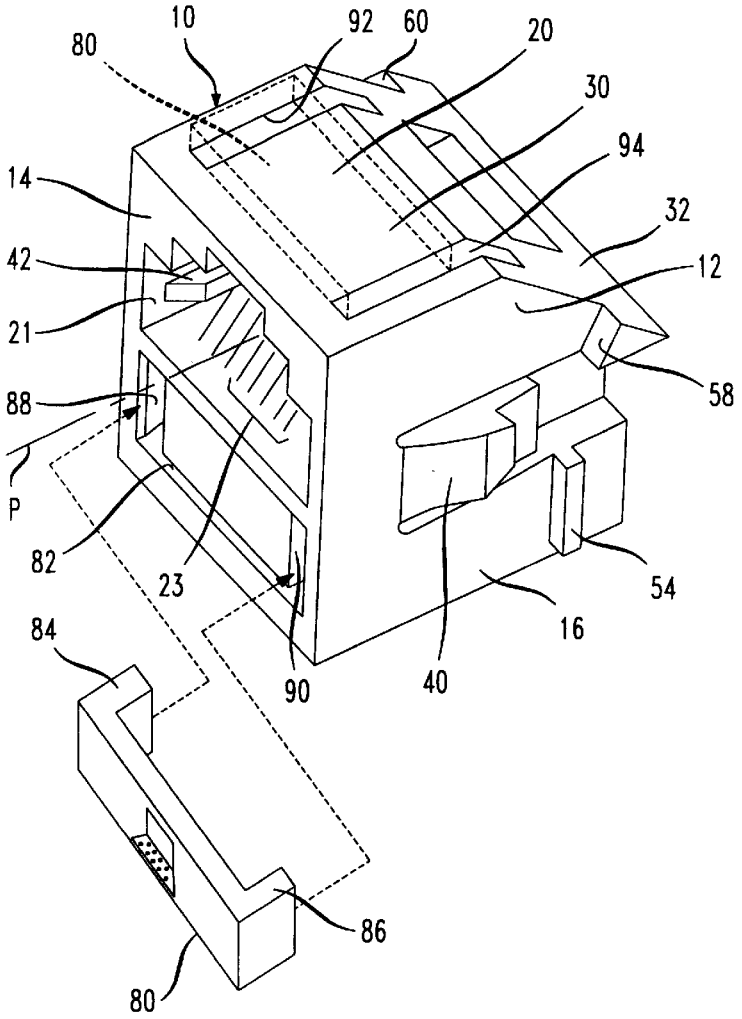
FIG. 1 is a perspective view of a jack frame according to the invention, including an icon tab that can be mounted on the frame at either one of two locations corresponding to a selected mounting orientation of the frame.

FIG. 1 is a perspective view of a jack frame 10 according to the invention. The jack frame 10 includes a jack frame block 12 formed of an electrically insulative material, preferably a plastics that can be molded and which meets all applicable standards with respect to electrical properties and flammability. Such plastics materials include but are not limited to polycarbonate, ABS, and blends thereof.

Figure 2:
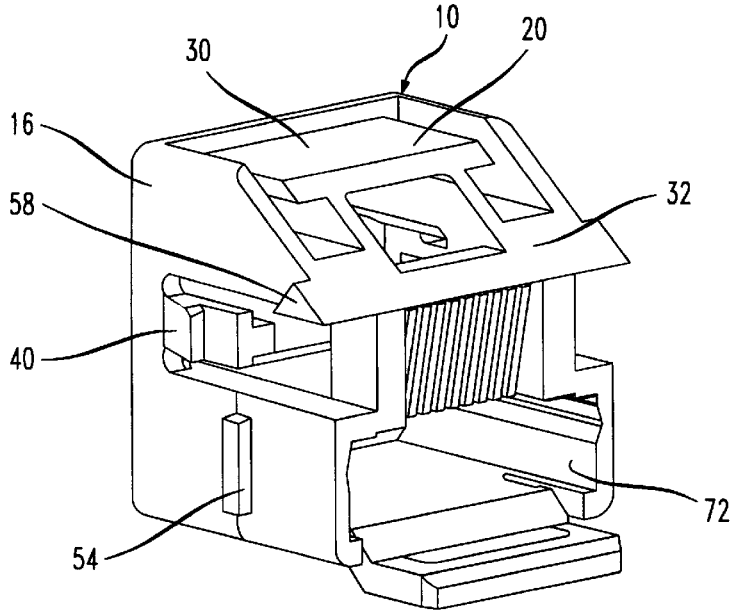
FIG. 2 is a perspective view of the jack frame looking from the rear in FIG. 1.
Figure 3:
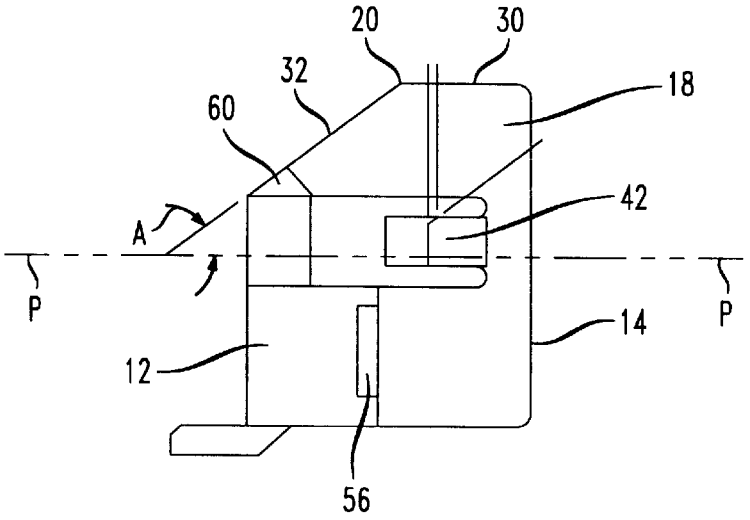
FIG. 3 is a side view of the jack frame as seen from the right side in FIG. 2.

The jack frame block 12 has a front surface 14, a pair of side surfaces 16, 18 (FIGS. 3 and 5), and a top surface 20. The front surface has a plug opening 21 with a plug axis P along which a communications plug can be inserted to engage and connect with terminals 23 in the frame block 12. The front surface 14 is dimensioned so that the frame block 12 can be received in a jack opening 22 in a face plate 24 as seen in FIG. 5. The face plate 24 and the configuration of its jack opening 22 are preferably similar to face plates having jack openings as disclosed in FIGS. 2–4 of the mentioned U.S. Pat. No. 5,096,439. All relevant portions of the '439 patent are incorporated by reference herein. Specifically, a portion of the inner periphery of the jack opening 22 is framed by a pair of side walls 26, 27, and a top wall 28 as shown in FIG. 5.

The top surface 20 of the jack frame block 12 has a first surface portion 30 (FIG. 1) that extends at a first angle with respect to the plug axis P of the frame block 12. In the illustrated embodiment, the first surface portion 30 extends substantially parallel (i.e., at 0 degrees) relative to the plug axis P. The frame block top surface 20 also has a second surface portion 32 which may be contiguous to the first surface portion 30, and which extends at a second angle with respect to axis P of the plug opening 21 in frame block 12. In the present embodiment, second surface portion 32 extends at an angle A of about 38 degrees relative to plug axis P. See FIG. 3.

Figure 6:
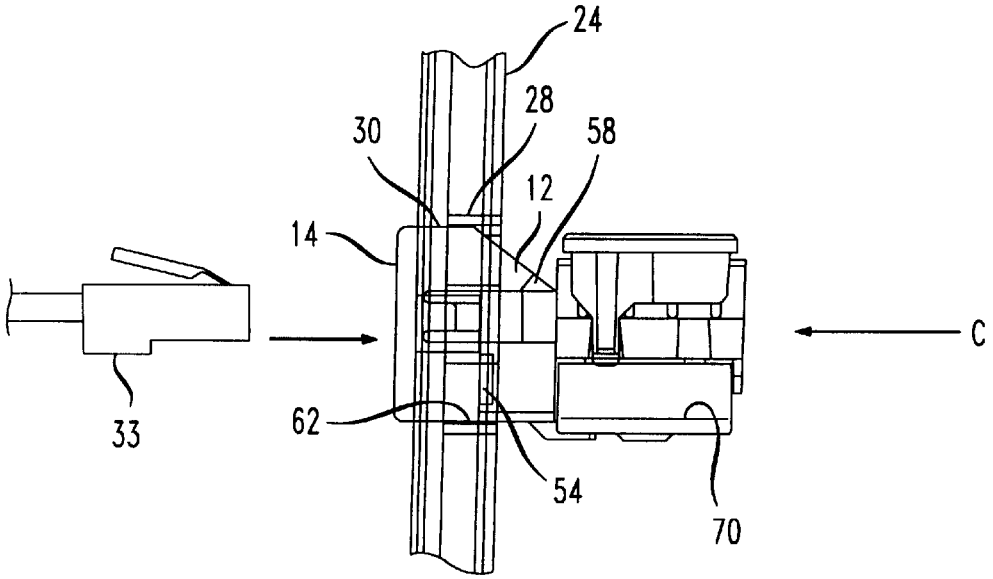
FIG. 6 is a side elevation view of the jack frame mounted in a flush orientation.
Figure 7:
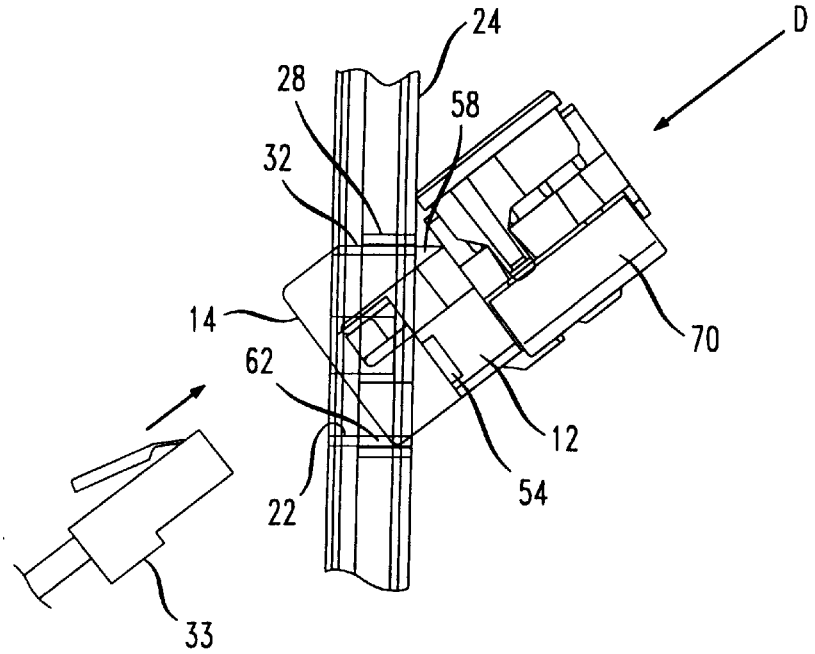
FIG. 7 is a side elevation view of the jack frame mounted in a sloped or downwardly inclined orientation.

When mounting the jack frame 10 on the face plate 24, either the first surface portion 30 or the second surface portion 32 of the frame block's top surface 20, can be aligned with the top wall 28 of the jack opening 22 in plate 24. Specifically, as shown in FIG. 6, frame block 12 is mounted on face plate 24 with the front surface 14 of the block substantially flush or parallel with the front of the face plate 24. The first surface portion 30 on the top surface of the block 12, is aligned flush with the top wall 28 that frames the jack opening in the face plate 24. In FIG. 7, the second surface portion 32 of the frame block top surface 20, is aligned flush with the top wall 28 of the jack opening in the face plate 24. It will be appreciated that the same jack frame block 12 is capable of providing two different mounting orientations one of which (FIG. 6) supports a mating communications plug 33 along a line perpendicular to the face plate 24, while the other (FIG. 7) accepts the mating plug 33 at an angle of, for example, about 38 degrees relative to the horizontal. Further construction details of the jack frame 10 now follow.

The present jack frame block 12 may in some respects be of similar construction as the communication jack or receptacle disclosed in the mentioned U.S. Pat. No. 5,041,018. All relevant portions of the '018 patent are incorporated by reference herein. Important differences in the construction of the present jack frame block 12 with respect to the jack of the '018 patent, are noted below Also, the present face plate 24 may be of identical or similar construction as a wall plate disclosed in FIGS. 2 and 3 of the mentioned U.S. Pat. No. 5,096,439. All relevant portions of the '439 patent are also incorporated by reference herein.

One important distinction between the present jack frame block 12 and the prior communication jack or module, is the formation of the second surface portion 32 following the first surface portion 30 on the present frame block 12, wherein the second surface portion 32 is inclined with respect to the plug axis A at such an angle as to cause the block 12 to face downward (see FIG. 7) when the second surface portion 32 is aligned with the top wall 28 of the face plate jack opening 22.

Whether the frame block 12 is mounted flush as in FIG. 6 or inclined as in FIG. 7, movement of the frame block 12 in a rearward direction relative to the face plate 24 is limited by the action of first engagement members in the form of flexible, wedge-shaped tabs 40, 42 protruding preferably from the side surfaces 16, 18 of the frame block. See FIG. 4. When the block 12 is inserted in the jack opening 22 from the rear of the face plate 24, inner portions of the tabs 40, 42 deflect into the plug opening 21 inside the block 12 as the tabs 40, 42 slide against the edges of the side walls 26, 27 framing the face plate jack opening 22. With continued movement toward the front of the face plate, the tabs 40, 42 snap outwardly to engage slots 46, 48 in the face plate side walls 27, 26, respectively. See FIG. 4.

Figure 4:
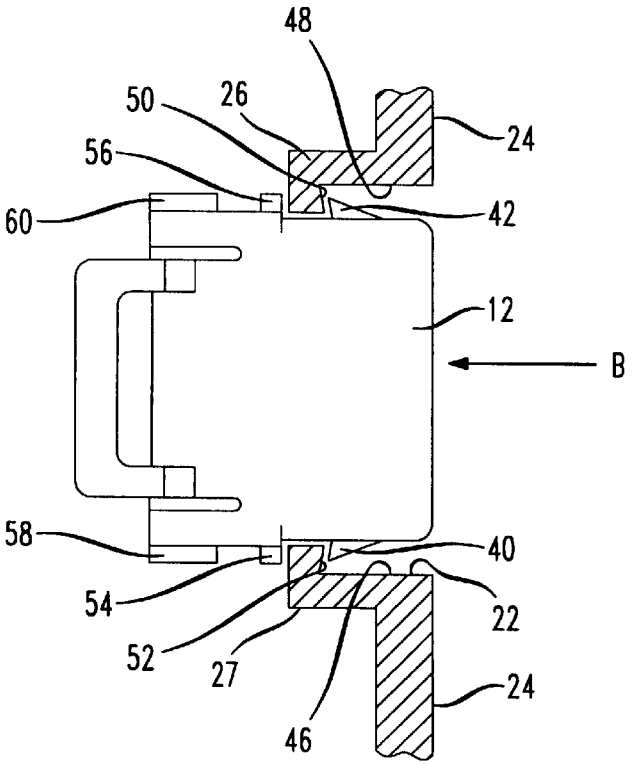
FIG. 4 is a bottom view of the jack frame in FIG. 3, showing the frame mounted in a flush orientation in a face plate.
Figure 5:
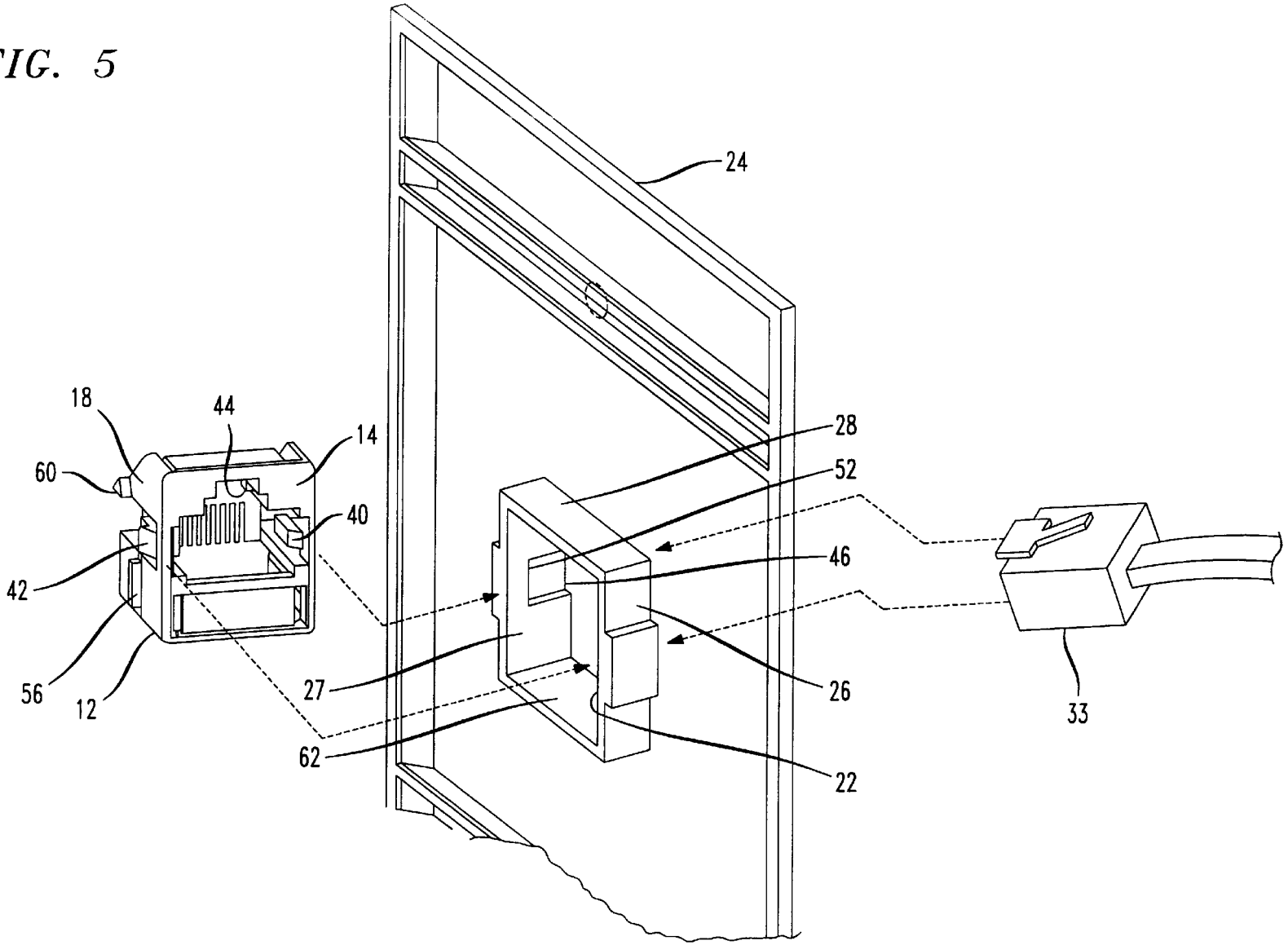
FIG. 5 is an assembly view of the jack frame, the face plate, and a communications plug arranged to connect to the jack frame when the frame is mounted on the face plate.

To ensure that frame block 12 will not be dislodged when a force is applied from the front of the frame block such as when inserting a plug in the direction of arrow B in FIG. 4, each of the tabs 40, 42 is formed to ratchet on corresponding vertical ledges 50, 52 at the rear ends of the slots 46, 48. Accordingly, when a force is applied to the block 12 in the direction of arrow B, the protruding tabs 40, 42 tend to deflect away from the side walls of the frame block and thus prevent the block from being inadvertently dislodged out the rear of the face plate 24.

After the protruding tabs 40, 42 snap into the corresponding side wall slots 46, 48, further movement of the frame block 12 toward the front of the face plate 24 is limited by the action of second engagement members which, in the embodiments of FIGS. 1–7 and FIG. 8, are located on the block side surfaces 16, 18. In the FIGS. 1–7 embodiment, a first set of the second engagement members in the form of vertical stop members 54, 56 are located to abut the rear edges of the face plate side walls 27, 26, respectively, just after the flexible protruding tabs 40, 42 snap in place in the side wall slots 46, 48 and the frame block 12 is mounted flush as in FIGS. 4 and 6. The stop members 54, 56 are located at the side of the plug axis P further from the top surface 20 of the frame block 12. Unlike the prior communications jacks, no vertical stop members are located at the side of the plug axis P closer to the top surface 20 of the frame block 12.

A second set of second engagement members in the form of inclined stop members 58, 60 are located on the side surfaces of the frame block 12 to abut corresponding edges of the face plate side walls 26, 27 just after the tabs 40, 42 snap into the side wall slots 46, 48 and the frame block 12 is mounted in the sloped orientation in FIG. 7. The stop members 58, 60 are located at the side of the plug axis P closer to the top surface 20 of the frame block 12, and serve to limit movement of the frame block toward the front of the face plate 24. Also, in the sloped orientation in FIG. 7, further movement of the frame block 12 in the direction of arrow D is stopped by the jack opening bottom wall 62, wherein the bottom wall 62 confronts a front bottom edge of the frame block 12 as shown in FIG. 7.

Before mounting the frame block 12 in either orientation of FIG. 6 or FIG. 7, an electrical connector 70 which may be of the insulation displacement kind and similar to connectors shown in the mentioned U.S. Pat. Nos. 5,096,439 and 5,096,442, is operatively inserted in a connector opening 72 at the rear of the jack frame block 12 (see FIG. 2). Cables running, for example, in a wall behind the face plate 24 are connected with contact terminals in the plug opening 21 of the frame block 12, by connecting with corresponding terminals of the electrical connector 70.

The present jack frame 10 is further distinguishable over the known communication modules or jacks in that it allows an icon tab 80 (FIG. 1) identifying the function of the jack frame, to be visibly mounted on the frame block 12 whether the frame block is mounted flush as in FIG. 6, or inclined as in FIG. 7. Specifically, when the frame block 12 is mounted in the flush orientation, the icon tab 80 is seated in an elongate recess 82 in the front surface 14 of the block. The recess 82 is aligned next to the mouth of the plug opening 21 in the frame block 12. The icon tab 80 has a pair of end legs 84, 86 that snap into corresponding slots 88, 90 at opposite ends of the recess 82.

If the jack frame block 12 is mounted in the inclined orientation of FIG. 7, the icon tab 80 is placed so that its end legs 84, 86 snap into corresponding slots 92, 94 in the top surface 20 of the frame block, and the icon tab 80 is seated on the first surface portion 30 on the block as shown in dotted lines in FIG, 1. The icon tab 80 thus can be mounted to be visible when a user is looking down on the first surface portion 30 of the frame block that protrudes from the face plate 24 in the sloped orientation in FIG. 7.

It will be appreciated that the present jack frame 10 is configured to allow it to be snapped into a standard outlet face plate in either a flush or a sloped orientation. The jack frame can be used with an identifying icon that can be attached at either of two locations corresponding to the flush or the sloped mounting orientation. The present jack frame 10 allows for either mounting orientation without requiring different jack frame blocks or otherwise having to manufacture two different jacks or face plates. Further, when in the flush mount orientation, it will be seen that the jack frame block 12 can be set so that the icon tab 80 is positioned either above or below the plug opening 21.

Figure 8:
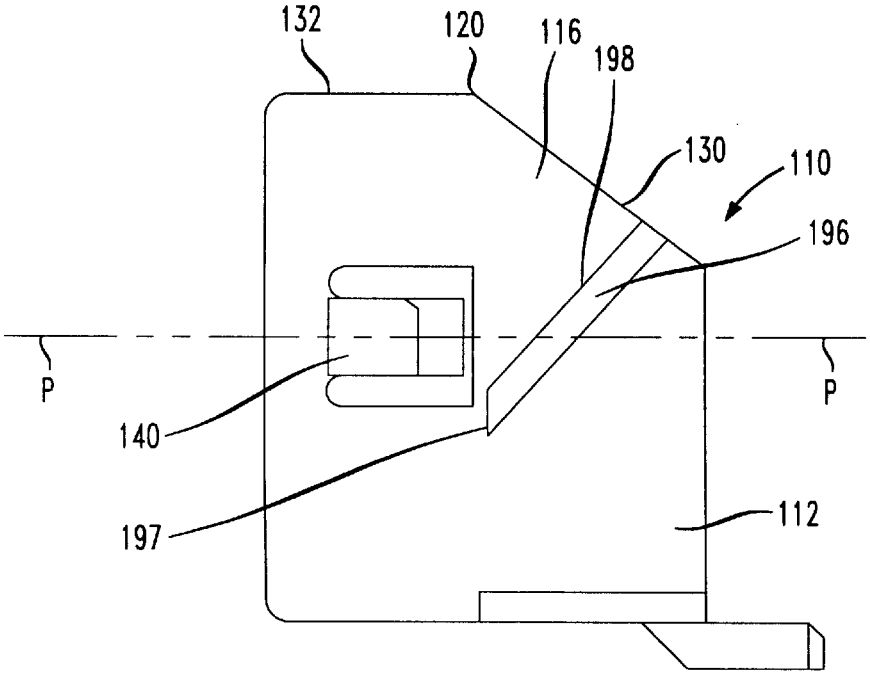
FIG. 8 is a side view of a second embodiment of a jack frame according to the invention.

FIG. 8 is a side view of a second embodiment of a jack frame 110, according to the invention. Parts corresponding to those in the embodiment of FIGS. 1–7 have corresponding reference numerals increased by 100.

The jack frame 110 differs from the jack frame 10 in FIGS. 1–7 with respect to the form and location of the second engagement members on the frame block 112. Specifically, an elongated, inclined stop member or bar protrudes from each block side surface. In FIG. 8, stop member 196 is shown protruding from the block side surface 116. The stop member forms a vertical stop surface 197 at an end of the member near first engagement member 140. The stop surface 197 comes into flush contact with a corresponding wall of a face plate opening, when the frame block 112 is mounted flush with respect to a face plate. Stop member 196 also forms an inclined stop surface 198 that comes into flush contact with a wall of the face plate opening, when the frame block 112 is mounted inclined with respect to the face plate. Accordingly, with the embodiment in FIG. 8, the stop member 196 and a similar stop member (not shown) on the opposite side surface of the frame block 112 act to hold the block at either a flush or an inclined mounting position on a given face plate.

Figure 9:
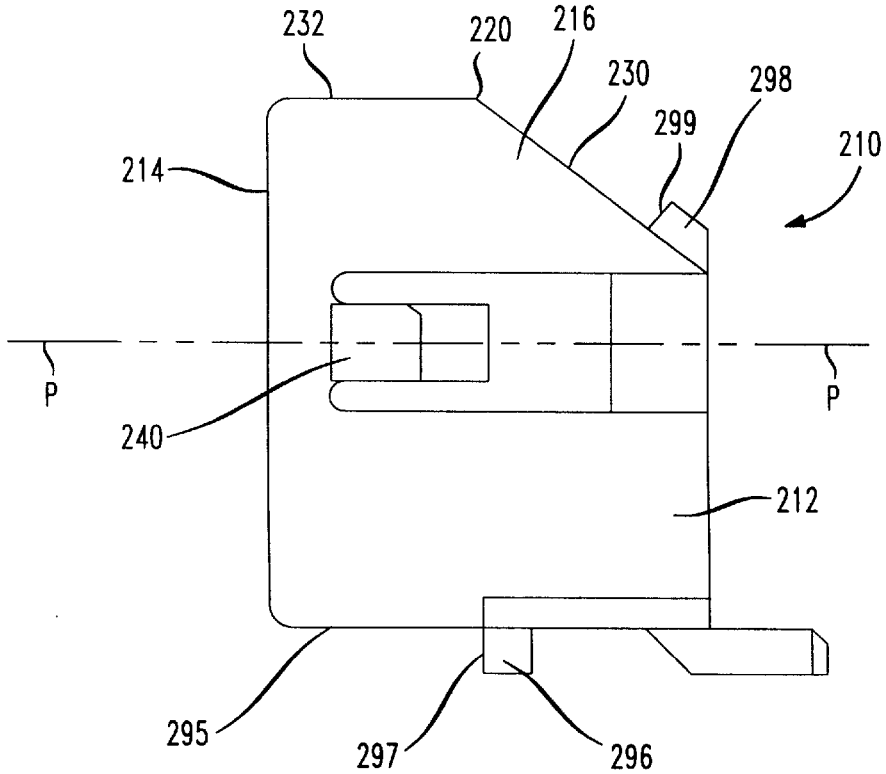
FIG. 9 is a side view of a third embodiment of a jack frame according to the invention.

FIG. 9 is a side view of a third embodiment of a jack frame 210, according to the invention. Parts corresponding to those in the embodiment of FIGS. 1–7 have corresponding reference numerals increased by 200.

The jack frame 210 in FIG. 9 differs from the jack frame 10 of FIGS. 1–7 with respect to the form and location of the second engagement members on the frame block 212. Specifically, a second engagement member in the form of an elongated stop member or bar 296 protrudes from a bottom surface 295 of the frame block 212, and extends parallel to the front surface 214 of the block. The stop member 296 forms a vertical stop surface 297 along a front-facing side of the member. The stop surface 297 comes into flush contact with a wall of a face plate opening when the frame block 212 is mounted flush with respect to a face plate. Another second engagement member in the form of an elongated stop member or bar 298 protrudes from the second surface portion 230 of the frame block 212, and extends parallel to a rear edge of the second surface portion. The stop member 298 forms an inclined stop surface 299 that comes into flush contact with a wall of a face plate opening when the frame block 212 is mounted inclined with respect to the face plate.

While the foregoing description represents a preferred embodiment of the invention, it will be obvious to those skilled in the art that various changes and modifications may be made without departing from the true spirit and scope of the invention, which is pointed out by the following claims.

I claim:

1. A jack frame for mounting in a jack opening in a face plate having a front side and a rear side, wherein the inner periphery of the jack opening is defined by a pair of jack opening side walls, a jack opening top wall and a jack opening bottom wall, the jack frame comprising;

a jack frame block having a front surface, a pair of side surfaces, a top surface and a bottom surface;

said front surface having a plug opening with a plug axis along which a plug connector is to be inserted to connect to said jack frame block, wherein said front surface is dimensioned to be received in the jack opening in the face plate;

the top surface of the jack frame block having a first surface portion extending substantially parallel to the plug axis of said plug opening, and a second surface portion extending at an acute angle with respect to the plug axis, wherein the first surface portion and the second surface portion are dimensioned and arranged so that either surface portion can be aligned flush with the top wall of the jack opening in the face plate so that the frame block can be mounted in the jack opening with either a parallel or an inclined orientation of the front surface of the frame block relative to the front side of the face plate, according to which one of the first and the second surface portions is aligned flush with the top wall of the jack opening; and first engagement members on the pair of side surfaces of said frame block, said first engagement members being constructed and arranged to engage the pair of side walls of the jack opening in the face plate when the frame block is mounted in either of the parallel or the inclined orientation, to limit movement of the frame block relative to the face plate.

2. A jack frame according to claim 1, wherein said first engagement members comprise flexible tabs protruding from the side surfaces of the frame block, for engaging corresponding slots in said pair of jack opening side walls.

3. A jack frame according to claim 1, including second engagement members on surfaces of said frame block, said second engagement members being constructed and arranged to engage corresponding walls of the jack opening when the frame block is mounted in either of the parallel or the inclined orientation from the rear side of said face plate to limit movement of the frame block toward the front side of said face plate.

4. A jack frame according to claim 3, wherein a first set of said second engagement members are in the form of first stop members located to abut rear edges of the pair of side walls of said jack opening when the jack frame is mounted in the parallel orientation relative to the front side of said face plate.

5. A jack frame according to claim 4, wherein a second set of said second engagement members are in the form of second stop members located to abut the rear edges of the pair of side walls of said jack opening when the jack frame is mounted in the inclined orientation relative to the front side of said face plate.

6. A jack frame according to claim 5, wherein said first set of second engagement members are located on the side surfaces of the jack frame block further from the top surface of the frame block than the plug axis, and the second set of second engagement members are located on the side surfaces of the jack frame block closer to the top surface of the frame block than the plug axis.

7. A jack frame according to claim 3, wherein said second engagement members are in the form of raised bars on the side surfaces of the frame block.

8. A jack frame according to claim 3, wherein at least one of said second engagement members is in the form of a raised bar on either one of the top surface and the bottom surface of said frame block.

9. A jack frame according to claim 1, including an icon tab having a legend corresponding to a intended function of the jack frame, and said frame block has recessed portions formed to seat the icon tab at a selected one of two different positions on the frame block so that the icon tab is visible to a user when the frame block is mounted in either one of the parallel and the inclined orientations relative to the front side of said face plate.

10. In combination;

a face plate having a front side and a rear side, and a jack opening, wherein the inner periphery of the jack opening is defined by a pair of jack opening side walls, a jack opening top wall and a jack opening bottom wall;

a jack frame block mounted in the jack opening of the face plate, wherein the jack frame block has a front surface, a pair of side surfaces, a top surface and a bottom surface;

the front surface of the jack frame block having a plug opening with a plug axis along which a plug connector is insertable to connect to said jack frame block;

the top surface of the jack frame block having a first surface portion extending substantially parallel to the plug axis of said plug opening, and a second surface portion extending at an acute angle with respect to the plug axis, wherein the first surface portion and the second surface portion are dimensioned and arranged so that either surface portion can be aligned flush with the top wall of the jack opening in the face plate so that the frame block is mounted on the face plate with either a parallel or an inclined orientation of the front surface of the frame block relative to the front side of the face plate, according to which one of the first and the second surface portions is aligned flush with the top wall of the jack opening; and first engagement members on the pair of side surfaces of said frame block, said first engagement members being constructed and arranged to engage the pair of side walls of the jack opening in the face plate when the frame block is mounted in either of the parallel or the inclined orientation, to limit movement of the frame block relative to the face plate.

11. The combination of claim 10, wherein said first engagement members comprise flexible tabs protruding from the side surfaces of the frame block, and said pair of jack opening side walls have slots for receiving corresponding ones of said tabs.

12. The combination of claim 10, including second engagement members on surfaces of the frame block, the second engagement members being constructed and arranged to engage corresponding walls of the jack opening when the frame block is mounted in either of the parallel or the inclined orientation from the rear side of the face plate to limit movement of the frame block toward the front side of the face plate.

13. The combination of claim 12, wherein a first set of said second engagement members are in the form of first stop members located to abut rear edges of the pair of side walls of said jack opening when the jack frame is mounted in the parallel orientation relative to the front side of the face plate.

14. The combination of claim 13, wherein a second set of the second engagement members are in the form of second stop members located to abut the rear edges of the pair of side walls of said jack opening when the jack frame is mounted in the inclined orientation relative to the front side of said face plate.

15. The combination of claim 14, wherein said first set of second engagement members are located on the side surfaces of the jack frame block further from the top surface of the frame block than the plug axis, and second set of second engagement members are located on the side surfaces of the jack frame block closer to the top surface of the frame block than the plug axis.

16. The combination of claim 12, wherein said second engagement members are in the form of raised bars on the side surfaces of the frame block.

17. The combination of claim 12, wherein at least one of said second engagement members is in the form of a raised bar on either one of the top surface and the bottom surface of said frame block.

18. The combination of claim 10, including an icon tab having a legend corresponding to an intended function of the jack frame, and said frame block has recessed portions formed to seat the icon tab at a selected one of two different positions on the frame block so that the icon tab is visible to a user when the frame block is mounted in either one of the parallel and the inclined orientations relative to the front side of said face plate.

* * * * *